US006616110B1

(12) United States Patent
McIntee

(10) Patent No.: US 6,616,110 B1
(45) Date of Patent: Sep. 9, 2003

(54) PAINT CAN ATTACHMENT WITH BRUSH HOLDING SLOT

(76) Inventor: Mark S. McIntee, 4302 Penn Ave., Baltimore, MD (US) 21236

( * ) Notice: Subject to any disclaimer, the term of this patent is extended or adjusted under 35 U.S.C. 154(b) by 0 days.

(21) Appl. No.: 10/068,532

(22) Filed: Feb. 8, 2002

(51) Int. Cl.[7] ..... F21V 35/00

(52) U.S. Cl. ..... 248/213.2; 248/110; 220/697; 220/701

(58) Field of Search ..... 220/691, 697, 220/700, 701, 570, 324; 248/110, 213.2; D9/434–436

(56) References Cited

U.S. PATENT DOCUMENTS

| | | | | | |
|---|---|---|---|---|---|
| 2,402,374 | A | | 6/1946 | Corn et al. | |
| 2,533,354 | A | * | 12/1950 | Comfort | 220/697 |
| 2,646,193 | A | | 7/1953 | Best | |
| 2,676,730 | A | | 4/1954 | Hedglon | |
| 2,745,570 | A | | 5/1956 | Miller | |
| 2,787,395 | A | * | 4/1957 | Florio | 15/209.1 |
| 2,803,374 | A | | 8/1957 | Cash | |
| 2,996,215 | A | | 8/1961 | Giza | |
| 3,048,299 | A | * | 8/1962 | Hutchinson | 220/270 |
| 3,704,007 | A | * | 11/1972 | Kroeger | 366/248 |
| 3,844,457 | A | | 10/1974 | Smart | |
| 3,894,650 | A | | 7/1975 | Crump | |
| 3,952,677 | A | * | 4/1976 | Hartman et al. | 220/606 |
| 4,009,802 | A | | 3/1977 | Hayduchok | |
| 4,014,453 | A | | 3/1977 | Tarnacki | |
| 4,150,763 | A | * | 4/1979 | Simpson | 220/287 |
| 4,380,304 | A | * | 4/1983 | Anderson | 215/DIG. 1 |
| 4,749,100 | A | * | 6/1988 | Eberhart | 220/258.2 |
| 4,993,671 | A | * | 2/1991 | Ste. Marie | 211/65 |
| D382,801 | S | * | 8/1997 | Samson | D9/435 |
| 5,683,009 | A | * | 11/1997 | King | 220/696 |

* cited by examiner

*Primary Examiner*—Korie Chan
(74) *Attorney, Agent, or Firm*—Kenneth A. Roddy

(57) ABSTRACT

A paint can attachment for supporting a paintbrush in a generally vertical position adapted to be removably mounted on an annular rim of a paint can having an inner circular wall with inner and outer surfaces, an annular bead at the top end thereof, and a concentric radially spaced circular rim channel. The attachment is a resilient integrally formed member having a planar generally crescent-shaped main body portion with lateral sides, an arcuate inner edge, a semicircular outer edge defined by a peripheral semicircular lip depending from an underside of the main body portion adapted to resiliently engage the outer surface of the inner wall of the rim, and a semicircular rib depending from the underside of the main body in radially inward spaced relation to the lip and terminating in an inner bead at its lower end adapted to snap over and frictionally engage the annular bead at the top of the rim inner wall. A generally rectangular slot in the main body portion extends radially outward from the arcuate inner edge and terminates a distance inwardly from the semicircular rib. The slot receives the handle portion of a paintbrush such that the paintbrush is supported in an upright generally vertical position in the paint can.

1 Claim, 3 Drawing Sheets

PAINT CAN ATTACHMENT WITH BRUSH HOLDING SLOT

BACKGROUND OF THE INVENTION

1. Field of the Invention

This invention relates generally to paint can attachments, and more particularly to a paint can attachment having a brush holding slot for holding a paintbrush in an upright position.

2. Brief Description of the Prior Art

There are several patents that disclose various paint can attachments which have a brush-wiping surface, attachments for holding a paintbrush on a paint can, and attachments to facilitate pouring of the paint from the can.

Most prior art devices for holding a paint brush support the brush in a generally horizontal position, or otherwise support the brush such that the bristles of the brush are not immersed in the paint but are exposed to the air and thus, the paint can become dried on the bristles of the brush when temporarily out of use.

Giza, U.S. Pat. No. 2,996,215 discloses a generally D-shaped paint can attachment having a semicircular outer side with a downwardly open groove that engages the rounded inner edge of the rim of a paint can and an inwardly extending plate-like portion having a straight side against which a paint brush may be wiped. A plurality of holes are provided adjacent to the outer side to allow drainage of excess back into the paint can. There is no provision for holding a paintbrush.

Hayduchok, U.S. Pat. No. 4,009,802 discloses a generally D-shaped device having a semiannular outer side with a bead and lip that engages the rim of a paint can and an opposed straight side against which a paint brush may be wiped, and also has an opening in the D-shaped portion that serves as a pouring outlet to facilitate pouring paint from the can. There is no provision for holding a paint brush.

Crump, U.S. Pat. No. 3,894,650 discloses a paint can attachment having a circular periphery that engages the rim of a paint can and an inwardly extending portion with a narrow rectangular slot that receives a flat stirring stick to hold it in a generally vertical position and the edges of the slot serve as a squeegee to wipe the stirring stick when it is withdrawn.

Best, U.S. Pat. No. 2,646,193 discloses an auxiliary partial paint can lid having a semicircular opening, a circular U-shaped peripheral flange that engages rim channel of a paint can, and a narrow rectangular slot that serves as a pouring aperture to facilitate pouring paint from the can.

Smart, U.S. Pat. No. 3,844,457 discloses a generally D-shaped paint can pour spout attachment with a semiannular outer side having a bead and lip that engages the rim of a paint can, an opposed straight side against which a paint brush may be wiped, an opening in the D-shaped portion that serves as a pouring outlet to facilitate pouring paint from the can, and a brush support clip for holding a paint brush in a generally horizontal position.

Hedglon, U.S. Pat. No. 2,676,730, Miller, U.S. Pat. No. 2,745,570, and Cash, U.S. Pat. No. 2,803,374 disclose paint brush holder attachments for paint cans that have a generally flat portion that extends outwardly from the paint can rim to support a paint brush in a generally horizontal position. These types of devices may be accidentally dislodged from the paint can when, for example, climbing up or down a ladder.

Tarnacki, U.S. Pat. No. 4,014,453 and Corn et al. U.S. Pat. No. 2,402,374 discloses devices that attach to a paint can, and a bucket, respectively, and have a rectangular slot for holding a paint brush in a generally vertical position. However, they have a generally J-shaped cross section and do not have a semiannular outer side with a bead and lip that engages the inner annular bead of a paint can rim.

The present invention is distinguished over the prior art in general, and these patents in particular by a paint can attachment for supporting a paintbrush in a generally vertical position which is adapted to be removably mounted on an annular rim of a paint can having an inner circular wall with inner and outer surfaces, an annular bead at the top end thereof, and a concentric radially spaced circular rim channel. The attachment is a resilient integrally formed member having a planar generally crescent-shaped main body portion with lateral sides, an arcuate inner edge, an arcuate outer edge defined by a peripheral arcuate lip depending from an underside of the main body portion adapted to resiliently engage the outer surface of the inner wall of the rim, and an arcuate rib depending from the underside of the main body in radially inward spaced relation to the lip and terminating in a rounded bead at its lower end adapted to snap over and frictionally engage the annular bead at the top of the rim inner wall. A generally rectangular slot in the main body portion extends radially outward from the arcuate inner edge and terminates a distance inwardly from the arcuate rib. The slot receives the handle portion of a paintbrush such that the paintbrush is supported in an upright generally vertical position in the paint can.

SUMMARY OF THE INVENTION

It is therefore an object of the present invention to provide a paint can attachment having a brush-holding slot for holding a paintbrush in a generally vertical position when temporarily out of use for short periods of time.

It is another object of this invention to provide a paint can attachment having a brush-holding slot for holding a paintbrush in a generally vertical position with the bristles immersed in the fresh paint when temporarily out of use for short periods of time to prevent paint from drying on the bristles of the brush.

Another object of this invention is to provide a paint can attachment having a brush-holding slot and an arcuate peripheral lip and bead which will firmly engage the inner annular bead of conventional paint cans to prevent accidental dislodgment.

Another object of this invention is to provide a paint can attachment having a brush-holding slot for holding a paintbrush in a generally vertical position and which has no projections extending outwardly from the can to prevent accidental dislodgment of the paint brush or holder when climbing up and down ladders.

Another object of this invention is to provide a brush-holding paint can attachment having a generally crescent-shaped configuration with an arcuate inner edge that extends into the opening of the paint can only a short distance beyond the inner wall of the paint can rim so as to not to cover a significant portion of the opening and reduce the likelihood of accidental dislodgment of the attachment when dipping the paintbrush into the paint can and removing it to apply paint.

Another object of this invention is to provide a paint can attachment having a brush-holding slot which has no projections extending upwardly or outwardly from the can which would interfere with the handle of the paint can.

A further object of this invention is to provide a paint can attachment having a brush-holding slot which can be easily and quickly installed and removed from a wide variety of paint can rim configurations.

A still further object of this invention is to provide a paint can attachment having a brush-holding slot that is simple in construction, inexpensive to manufacture, and rugged and reliable in use.

Other objects of the invention will become apparent from time to time throughout the specification and claims as hereinafter related.

The above noted objects and other objects of the invention are accomplished by a paint can attachment for supporting a paintbrush in a generally vertical position which is adapted to be removably mounted on an annular rim of a paint can having an inner circular wall with inner and outer surfaces, an annular bead at the top end thereof, and a concentric radially spaced circular rim channel. The attachment is a resilient integrally formed member having a planar generally crescent-shaped main body portion with lateral sides, an arcuate inner edge, an arcuate outer edge defined by a peripheral arcuate lip depending from an underside of the main body portion adapted to resiliently engage the outer surface of the inner wall of the rim, and an arcuate rib depending from the underside of the main body in radially inward spaced relation to the lip and terminating in a rounded bead at its lower end adapted to snap over and frictionally engage the annular bead at the top of the rim inner wall. A generally rectangular slot in the main body portion extends radially outward from the arcuate inner edge and terminates a distance inwardly from the arcuate rib. The slot receives the handle portion of a paintbrush such that the paintbrush is supported in an upright generally vertical position in the paint can.

DESCRIPTION OF THE PREFERRED EMBODIMENT

Figure 1:
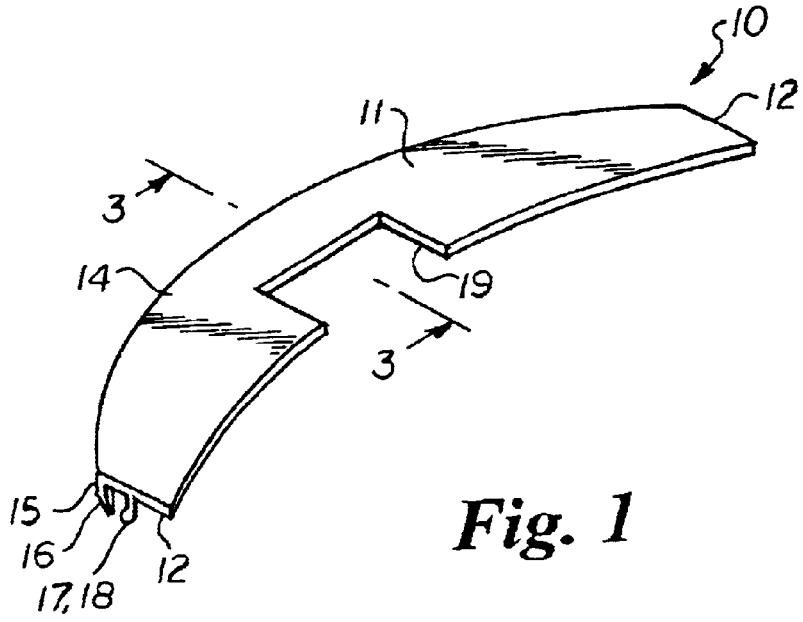
FIG. 1 is a perspective view of the paint can attachment in accordance with the present invention, shown from the top.
Figure 2:
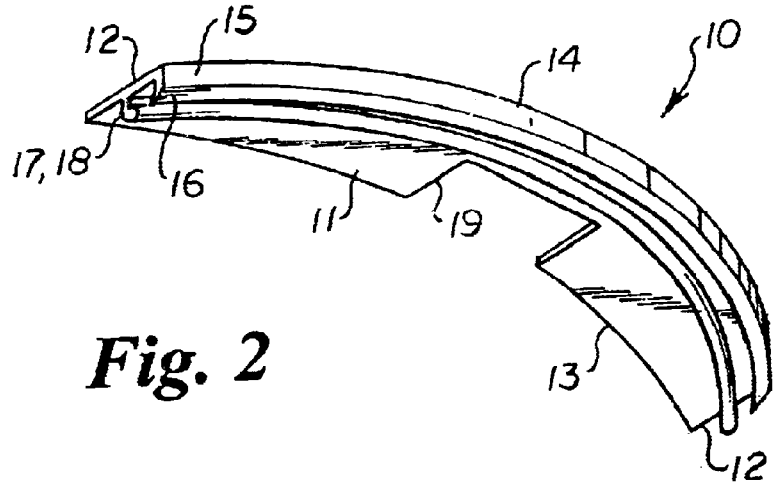
FIG. 2 is a perspective view of the paint can attachment, shown from the bottom.
Figure 3:
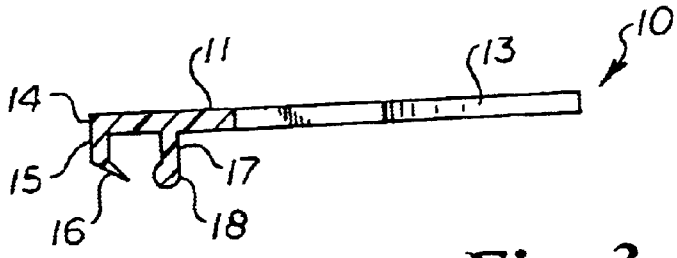
FIG. 3 is an enlarged cross sectional view through the paint can attachment taken along line 3—3 of FIG. 1.

Referring to the drawings by numerals of reference there is shown in FIGS. 1, 2, and 3, a preferred paint can attachment 10. In a preferred embodiment, the paint can attachment 10 is molded of suitable resilient plastic material such as polypropylene or polyethylene and has a generally crescent shaped configuration.

The attachment 10 has a flat planar main body portion 11 with lateral sides 12, an arcuate inner edge 13, and an arcuate outer edge 14 defined by a depending peripheral lip 15 of a diameter sufficient to be received in the outer recessed rim channel of a conventional paint can (described hereinafter). The lip 15 extends vertically downward a short distance from the underside of the main body 11 and terminates in a wedge-shaped inwardly facing portion 16. A thin arcuate rib 17 depends from the underside of the main body 11 in radially inward spaced relation to the lip 15 and terminates in a rounded bead 18 at its lower end.

A generally rectangular slot 19 formed in the main body portion 11 extends radially outward from the arcuate edge 13 and terminates a distance inwardly from the arcuate rib 17 with its open end facing the center of the paint can. The slot 19 is of sufficient width and length to receive and support the handle portion of a conventional paintbrush.

Figure 4:
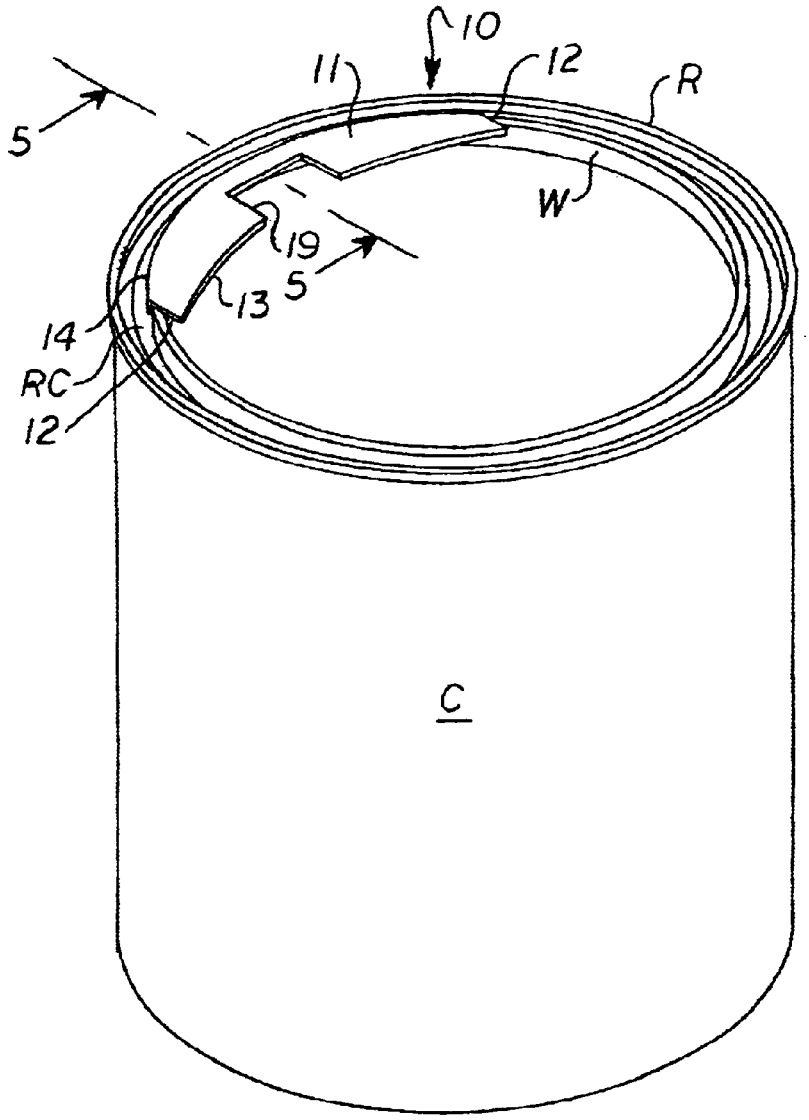
FIG. 4 is a perspective view of the paint can attachment installed on the open end of a paint can.
Figure 5:
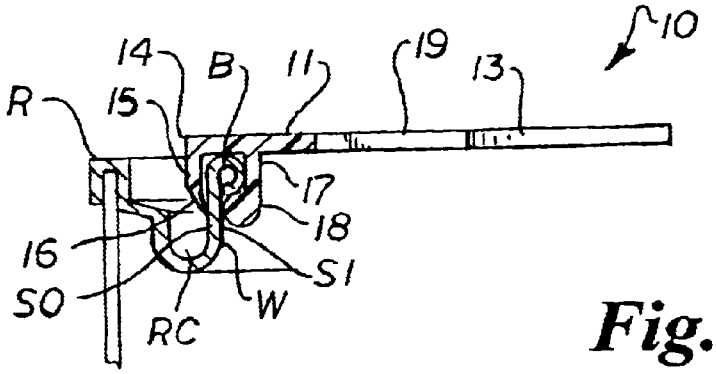
FIG. 5 is an enlarged cross sectional view taken along line 3—3 of FIG. 1 showing a portion of the paint can rim with the paint can attachment attached thereon.
Figure 6:
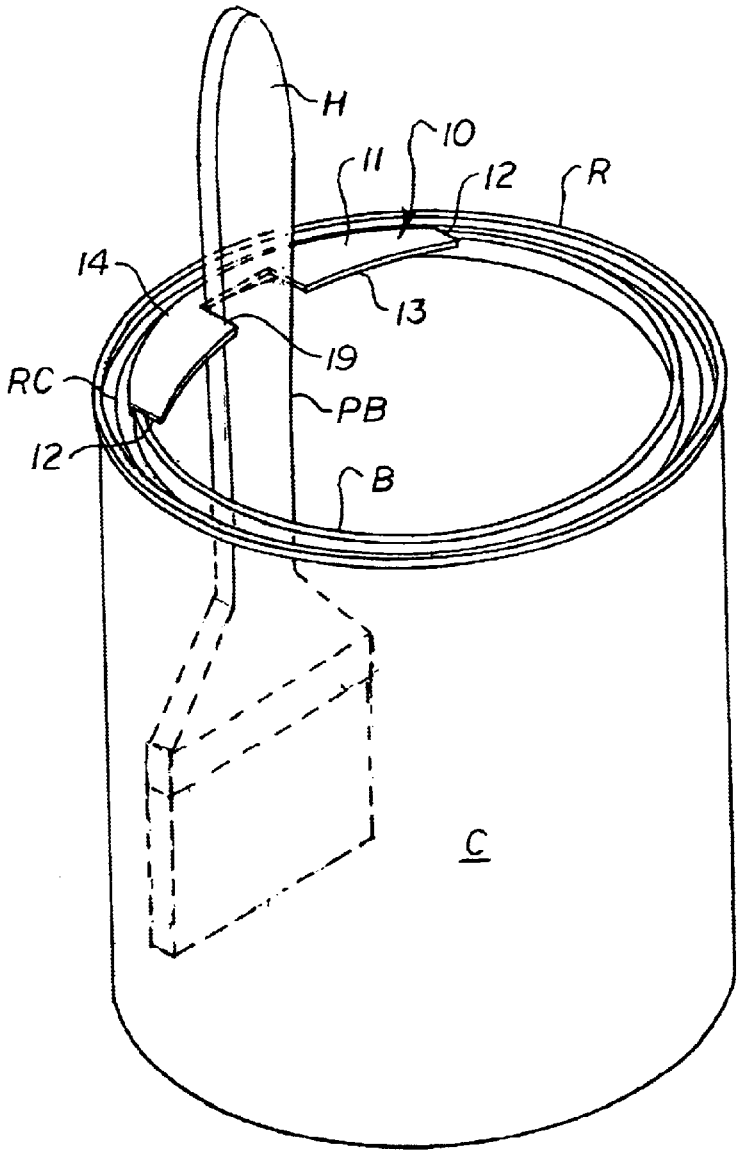
FIG. 6 is a perspective view of the paint can attachment installed on the rim of a paint can with the handle of a paintbrush received in the brush-holding slot.

FIGS. 4, 5 and 6 show the attachment 10 attached onto the open top end of a conventional paint can C. As best seen in FIG. 5, the topmost portion of the paint can C is circumscribed by an outer rim R that serves to partially enclose and support the lid of the can. The circular opening of the paint can C is defined by an annular bead B formed at the top end of i circular inner wall W which is concentric with the outer rim R and disposed inwardly therefrom. A recessed circular rim channel RC is disposed concentrically between the inner wall W and outer rim R. The inner wall W has an outer surface SO facing the inner wall of the outer rim R, and an inner surface SI facing the circular opening. Depending on the manufacturer, the paint can rim details may vary, but the details of the circular inner wall W and annular bead B of the rim are fairly consistent.

The distance between the vertical portion of the lip 15 and the inner bead 18 of the attachment 10 is sufficient to provide a snap-fit engagement onto the annular bead B of the paint can when pressed downwardly thereon. As shown in FIG. 5, when properly installed, the inner bead 18 of the attachment 10 is frictionally engaged beneath the annular bead B of the paint can C and the lip 15 resides in the rim channel RC with its inwardly facing wedge-shaped portion 16 resiliently biased against the outer surface SO of the inner wall W surrounding the paint can opening to firmly hold the attachment 10 in place.

As seen in FIG. 6, after the paint can attachment 10 has been installed, the slot 19 provides a convenient receptacle for receiving the handle portion H of the paintbrush PB. The paintbrush can thus be maintained in an upright generally vertical position when temporarily out of use. In this position, the bristles of the brush are immersed in the fresh paint in the can and are not exposed to the air, thus preventing paint from drying on the bristles of the brush. It should also be noted that the present paint can attachment has no projections extending upwardly or outwardly from the paint can that would interfere with the handle of the paint can or cause accidental dislodgment of the paintbrush or attachment when climbing up and down ladders. The center portion of the arcuate inner edge 13 of the attachment 10 extends into the opening of the paint can a short distance beyond the inner wall W and is curved so as to not cover a significant portion of the opening and reduce the likelihood of accidental dislodgment of the attachment when dipping the paintbrush into the paint can and removing it to apply paint.

While this invention has been described fully and completely with special emphasis upon a preferred embodiment, it should be understood that within the scope of the appended claims the invention may be practiced otherwise than as specifically described herein.

What is claimed is:

1. A paint can attachment for supporting a paintbrush in a generally vertical position adapted to be removably mounted on an annular rim of a paint can having an inner circular wall with inner and outer surfaces, an annular bead at the top end thereof, and a concentric radially spaced recessed circular rim channel, the attachment comprising:

a resilient integrally formed member having a planar generally crescent-shaped main body portion with lateral sides;

an arcuate inner edge extending between said lateral sides sized and curved to extend into the opening of the paint can a short distance beyond said inner circular wall of the paint can rim;

an arcuate peripheral outer edge;

an arcuate lip depending a short distance downward from said arcuate peripheral outer edge terminating in a wedge-shaped inwardly facing portion sized and shaped to be engaged and resiliently biased against the outer surface of the inner circular wall of the paint can rim;

an arcuate rib depending from the underside of said main body portion in radially inward spaced relation to said arcuate lip terminating in a rounded bead at a lower end adapted to snap over and frictionally engage said annular bead at the top end of the inner circular wall of the paint can rim; and a single generally rectangular slot in said main body portion extending radially outward from said arcuate inner edge terminating a distance inwardly from said arcuate rib and having a width and length sufficient to receive a handle portion of the paintbrush and support the paintbrush in an upright generally vertical position in the paint can; wherein said wedge-shaped inwardly facing portion is resiliently biased against the outer surface of the inner circular wall of the paint can rim when said rounded bead is frictionally engaged beneath said annular bead at the top end of the wall to firmly hold said attachment on the paint can rim, said arcuate peripheral outer edge does not extend outwardly beyond the recessed circular rim channel, and said arcuate inner edge does not cover a significant portion of the paint can opening to reduce likelihood of accidental dislodgment of said attachment when dipping the paintbrush into the paint can and removing it to apply paint.

* * * * *